United States Patent [19]

Shindo et al.

[11] 3,967,795

[45] July 6, 1976

[54] BOBBIN TUBE

[75] Inventors: Noboru Shindo; Mistuhiko Miyaoka, both of Kyoto, Japan

[73] Assignee: Murata Machinery Ltd., Tokyo, Japan

[22] Filed: Feb. 4, 1974

[21] Appl. No.: 438,510

[30] Foreign Application Priority Data

Feb. 8, 1973 Japan ..... 48-16244

[52] U.S. Cl. ..... 242/125.1

[51] Int. Cl.[2] ..... B65H 75/28

[58] Field of Search ..... 242/125.1, 18 PW; 24/DIG. 18

[56] References Cited

UNITED STATES PATENTS

| | | | |
|---|---|---|---|
| 2,243,101 | 5/1941 | Kinsella | 242/125.1 |
| 3,625,451 | 12/1971 | Anderson | 242/125.1 |

FOREIGN PATENTS OR APPLICATIONS

| | | | |
|---|---|---|---|
| 1,557,744 | 1/1969 | France | 242/125.1 |
| 450,855 | 4/1968 | Switzerland | 242/125.1 |
| 253,745 | 6/1927 | United Kingdom | 242/125.1 |
| 1,184,873 | 6/1967 | United Kingdom | 24/DIG. 18 |

*Primary Examiner*—Leonard D. Christian
*Attorney, Agent, or Firm*—Michael J. Striker

[57] ABSTRACT

A bobbin tube, particularly suitable for use in filament winding apparatus having automatic bobbin-changing mechanisms, has a tubular body provided on its outer circumferential surface with tentacular filament engaging material provided on at least one portion of this surface, so as to engage and capture a filament which moves over the surface.

5 Claims, 6 Drawing Figures

BOBBIN TUBE

BACKGROUND OF THE INVENTION

The present invention relates generally to a bobbin tube, and more particularly to a bobbin tube which is especially suited for use in filament winding apparatus of the type having automatic bobbin-changing mechanisms, but which can also be employed otherwise.

Filament or thread winding apparatus is well known in the art. It utilizes one or more bobbin winding chucks which are rotatable and which usually can be moved into and out of engagement with the periphery of a drive roll, so that the chucks are surface driven. The chucks are generally cylindrical and bobbin tubes of paper or another material are slipped onto them and can then rotate with the chuck. A filament is supplied to the chuck from a supply, in some instances directly from an apparatus for producing synthetic plastic filaments, and is wound onto the bobbin tube to form thereon a filament package or cop.

In modern winders of this type, which must be capable of high-speed operation and preferably should operate continuously, automatic bobbin-changing mechanisms are provided which, when a yarn package or cop has been fully formed on a bobbin tube, move the bobbin tube with the yarn package thereon from the chuck and replace it with a new empty bobbin tube. One type of prior-art apparatus operating on this principle uses a pivoted arm carrying at each end one of the chucks so that, when a bobbin tube with a full yarn package is removed from one of the chucks, the arm is tilted so that the bobbin tube on the other chuck in the meantime is in contact with the drive roll and receives filament from the same. By the time the yarn package has built up on this previously empty bobbin tube, the package on the other chuck has been replaced with a new empty bobbin tube which is now ready to be in turn brought into contact with the surface of the drive roll.

In this type of apparatus, difficulties have been encountered in transferring the yarn or filament from the completed package which is running by contact with the drive roll, to the empty bobbin tube that is on the other chuck. It is known to provide the bobbin tubes with a notch or similar detent, to capture the yarn which moves axially of the bobbin tube, or else to provide adhesive means on the bobbin tube for the same purpose. However, neither of these possibilities has to be found to be particularly advantageous, and especially where a so-called bunch winding is required on the bobbin tube, that is where the yarn must not immediately begin to traverse axially of the bobbin tube but is first required to form a number of convolutions in one spot before the traversing and subsequent buildup of the package begins, the problem of making the yarn remain at such a location that the buildup of the bunch winding can be completed, has not been satisfactorily solved in the prior art.

Moreover, the expedients which have been used in the prior art, for instance the application of adhesive strips to the outer surface of the bobbin tube, have the additional disadvantage of making the tubes difficult to handle and, at least in the case of adhesive strips, of being usable only once and having to be replaced for the next operation.

SUMMARY OF THE INVENTION

It is, accordingly, a general object of the invention to overcome the disadvantages of the prior art.

More particularly, it is an object of the invention to provide an improved bobbin tube, which is particularly but not exclusively suitable for use in automatic bobbin-changing filament winding apparatus, which is not possessed of the aforementioned disadvantages.

An additional object of the invention is to provide such an improved bobbin tube wherein the yarn or filament can be captured readily and reliably and the means for effecting the capture can be used time and again without having to be renewed.

In keeping with these objects, and with others which will become apparent hereafter, one feature of the invention resides in a bobbin tube, particularly for use in filament winding apparatus having automatic bobbin-changing mechanisms. The bobbin tube has a tubular body provided with an outer circumferential surface, and on at least one portion of this outer circumferential surface there is provided tentacular filament engaging means which engages and captures a filament moving over the surface of the tubular body.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
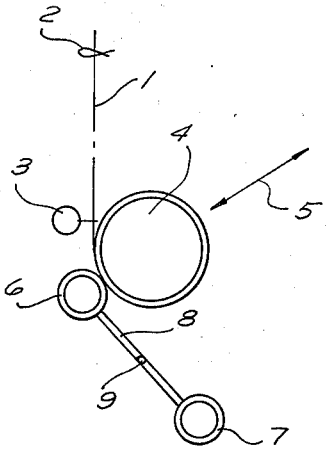
FIG. 1 is a diagrammatic end-elevational view of those portions of a filament winding apparatus which are considered necessary for an understanding of the invention.

Referring firstly to FIG. 1 it is emphasized that this Figure illustrates diagrammatically and in an end view only those portions of a filament winding apparatus which are believed to be required for an understanding of the operation of such apparatus, and of the context of the invention. Apparatus of this type is well known in the art and those conversant with this field will fully understand the type of construction and operation of such apparatus. However, if further details are desired, reference may be had to U.S. Pat. No. 3,165,274 (DePriest) and to U.S. Pat. No. 3,409,238 (Campbell), both of which disclose apparatus of the general type here in question.

In apparatus of this type, a filament 1 which is supplied from a non-illustrated supply and passes through a guide 2, travels to a traverse 3 which is shown only diagrammatically but should be understood to engage the filament 1 and to traverse it back and forth in direction normal to the plane of FIG. 1. The filament runs onto the circumferential surface of a driven drive roll 4. A support or arm 8 is mounted adjacent the drive roll 4 and pivotable about a pivot 9. It carries at its opposite ends two chucks 6 and 7, respectively, onto each of which a bobbin tube 10 of paper or the like is to be slipped. Expansion mechanisms or similar devices are provided conventionally on these chucks which hold the bobbin tubes in place so that as the chuck rotates, the bobbin tube must rotate with it. The rotation is imparted to the chucks 6, 7 by frictional engagement with the surface of the drive roll 4. In order to provide for continuous operation of the apparatus, the arm 8 can be pivoted about the pivot 9 so that alternately the chuck 6 and the chuck 7 are moved into engagement with the circumferential surface of the drive roll 4.

Figure 2:
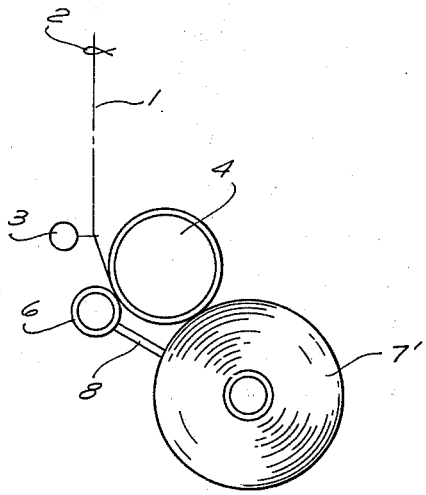
FIG. 2 is a view similar to FIG. 1, but showing a completed yarn package on the apparatus.

FIG. 2 shows that if for instance a bobbin tube 10 is mounted on the chuck 7 and the latter is in contact with the drive roll 4, a yarn package 7' will build up on the bobbin tube. When the yarn package 7' has reached a predetermined diameter, the apparatus will automatically move the chuck 6 into engagement with the drive roll 4, while at the same time moving the yarn package 7' away from the drive roll 4. Now, the filament or yarn 1 runs onto the bobbin tube which is mounted on the chuck 6, and as this takes place the package 7' can be removed from the chuck 7 and a new empty bobbin tube 10 placed onto the latter. When the yarn package on chuck 6 has built up to predetermined diameter, the operation is reversed.

Figure 3:
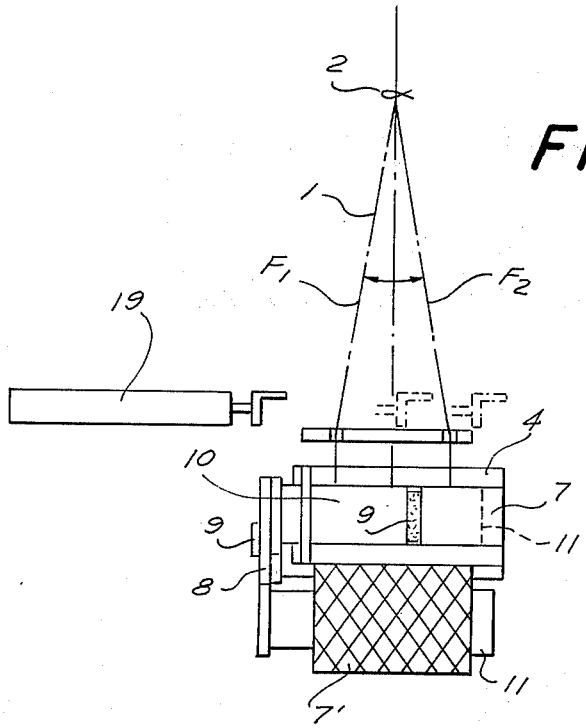
FIG. 3 is a side view of FIG. 2, looking from the lower left towards the upper right of FIG. 2.

When yarn is transferred from a full package to an empty bobbin tube on the other chuck, the yarn 1 is engaged by a conventional yarn shifting device 19, for instance a hydraulic piston and cylinder unit or a mechanical device, which shifts it to the position designated $F_2$ in FIG. 3, it being understood and indicated by the curved double-headed arrow in that Figure that the traversing device 3 traverses the yarn during the buildup of the package between the positions $F_1$ and $F_2$. When the device 19 has shifted the yarn to the position $F_2$, it holds it there as indicated by the fragmentarily shown broken-line portion of the device 19 at the right-hand side of FIG. 3, so that the yarn 1 can now enter into a notch 11 formed at the axial end of the new bobbin tube 10 which has been slipped onto the chuck, in this embodiment the chuck 6. When subsequently the traversing operation is to begin again the device 19 is retracted to the left-hand position in FIG. 3. When this takes place, the yarn 1 begins to shift from the position $F_2$ back to the position $F_1$, thus being traversed axially of the bobbin tube 10. It is also possible, however, that in some instances it is desired to first form a bunch winding at the one end of the bobbin tube, here the right-hand end, that is to form a number of convolutions of the yarn about the bobbin tube before the traversing and buildup of the package begins. In this case, the device 19 would remain in the right-hand position of FIG. 1 until the bunch winding is completed.

The problem is that the notch 11 is outside the yarn traversing range which is indicated by the positions $F_1$ and $F_2$, so that yarn that is guided by the device 19 after being separated from the preceding full package 11' will experience an abrupt yarn slackening. This slackening may be so extensive as to either cause disengagement of the yarn from the notch 11 or its improper engagement therein in the first place, or else the yarn may not even be wound onto the bobbin tube 10 but may instead begin to form convolutions about the drive roll 4 which would necessitate stopping the machine until these convolutions have been removed from the drive roll.

Figure 4:
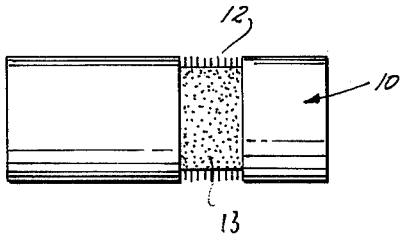
FIG. 4 is a side elevation of a bobbin tube for use on the apparatus of FIGS. 1–3, according to one embodiment of the invention.
Figure 6:
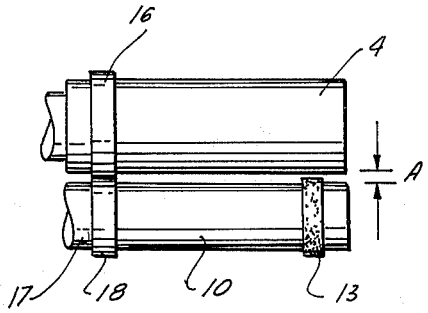
FIG. 6 is a somewhat different embodiment of the invention, illustrated in a side view.

The present invention overcomes these disadvantages by utilizing a novel bobbin tube which is shown in one embodiment in FIG. 4 and in another embodiment in FIG. 6.

Figure 5:
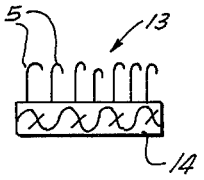
FIG. 5 is a section through the filament engaging means of the bobbin tube in FIG. 4.

Referring firstly to FIG. 4 it will be seen that the bobbin tube 10 has an outer circumferential surface which may be formed with a depression 12, for instance in form of a circumferentially extending groove. According to the invention, there is located in this groove a tentacular filament engaging element 13 which is shown in cross section in FIG. 5 and which comprises a base 14 that may be of fabric in form of a ribbon or tape, and a plurality of synthetic plastic filamentary hooks 15 which project from the base 14, being suitable affixed in the same. Such material is commercially available under the trade name "Velcro" and can be placed into the groove 12 in form of a strip 13. Advantageously, the depth of the groove 12 corresponds to the thickness of the strip 13, so that the upper ends of the hooks 15 are substantially flush with the surface of the bobbin tube 10. The reverse side of the base 14, that is the side which is not provided with the hooks 15, may be provided with a suitable adhesive, for instance analogous to those used on adhesive tapes, so that the strip 13 can be readily affixed to the bobbin tube 10.

It should be understood that it is possible to have the strip 13 extend not around the entire circumference of the bobbin tube 10, but only over a portion of the circumference; for instance it has been found that in many cases it will be sufficient if the strip 13 extends over approximately one-tenth of the bobbin tube circumference. Evidently, the member 13 need not be strip-shaped, but could have a different configuration. FIG. 6 shows that the member 13 could also be provided directly on the outer circumferential surface of the bobbin tube, instead of being recessed as shown in FIG. 4. In that case, however, it is necessary to assure that a distance A remains between the outer circumferential surface of the bobbin tube 10 and the circumferential surface of the drive roll 4. This can be done by providing the drive roll 4 with a circumferentially extending drive rim 16 which cooperates with a similar drive rim 18 formed on the respective chuck, which is here identified with reference numeral 17. In this case, the chuck 17 will be driven by cooperation of the rims 16 and 18 until sufficient yarn is built up on the surface of the bobbin tube 10 to bridge gap A; subsequently, drive will be transmitted by surface engagement between the roll 4 and the surface of the building yarn package.

With a bobbin tube constructed according to the present invention, yarn or filament 1 which moves axially of the bobbin tube 10 will be engaged —and reliably so— as soon as it moves into contact with the strip or member 13. The hook-shaped portions 15 will reliably engage the yarn or filament 1 and will assure that no slack can develop. If it is desired to form a bunch winding on the bobbin tube, The device 19 can be used to guide the yarn or filament 1 outside the range of the member 13 —always being assured of appropriate tension— to a place where the bunch winding is to be formed, whereupon normal traversing of the yarn or filament 1 will begin to form the yarn package.

It is evident that it is possible to locate the member 13 anywhere along the bobbin tube 10, wherever such positioning is desired. For instance, it can be located as shown in FIG. 4, that is in a midportion of the bobbin tube intermediate the opposite axial end portions thereof, or it can be located in the region of one of the axial end portions as shown in FIG. 6. This depends upon the requirements of a particular application.

The bunch winding, it should be mentioned for a completeness of understanding of the term, serves as a transfer tail, that is when the yarn package is completed and is later used in a spinning machine or the like, the length of yarn which forms the bunch winding can be pulled off from the bobbin tube since it is not covered by the remainder of the yarn package, and can be tied to a similar length on a yarn package from which filament is already being withdrawn for use in the machine. Subsequently, when this working yarn package is exhausted, an automatic transfer of yarn withdrawal from the exhausted package to the next package will occur since the two transfer tails have been connected. This, however, is not a part of the invention and is mentioned only for explanation.

It will be understood that each of the elements described above, or two or more together, may also find a useful application in other types of constructions differing from the types described above.

While the invention has been illustrated and described as embodied in a bobbin tube, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A bobbin tube, particularly for use with filament winding apparatus having automatic bobbin change mechanism, comprising a tubular body having a smooth cylindrical surface and being provided in said surface with a shallow depression extending in circumferential direction at least partly about the circumference of the tubular body within the traversing range of a filament to be wound in form of a yarn package on said tubular body; and resilient tentacular filament engaging means of synthetic plastic material extending in radial direction in said depression with outer ends thereof substantially flush with said cylindrical surface of said tubular body for engaging and capturing a filament moving over said engaging means.

2. A bobbin tube as defined in claim 1, wherein said tentacular filament engaging means located in said depression is substantially flush with the remainder of said circumferential surface.

3. A bobbin tube as defined in claim 2, wherein said depression is an annular groove extending circumferentially of said tubular body; and wherein said filament engaging means is strip-shaped.

4. A bobbin tube as defined in claim 1, wherein said tubular body has a center portion and opposite axial end portions; and wherein said depression is located on, between said axial end portions.

5. A bobbin tube as defined in claim 4, and including a circumferentially extending notch located in the region of one of said end portions outside the filament traversing range.

* * * * *